US005729079A

United States Patent [19]

Franck

[11] Patent Number: 5,729,079

[45] Date of Patent: Mar. 17, 1998

[54] COMPACT FLUORESCENT LIGHT BULB

[75] Inventor: Günter Franck, Ebenhausen, Germany

[73] Assignee: Patent-Treuhand-Gesellschaft für elektrische Glühlampen mbH, Munich, Germany

[21] Appl. No.: 535,150

[22] PCT Filed: Apr. 27, 1994

[86] PCT No.: PCT/DE94/00464

§ 371 Date: Oct. 23, 1995

§ 102(e) Date: Oct. 23, 1995

[87] PCT Pub. No.: WO94/25978

PCT Pub. Date: Nov. 10, 1994

[30] Foreign Application Priority Data

May 4, 1993 [DE] Germany ..... 43 14 744.5

[51] Int. Cl.[6] ..... H01J 61/30

[52] U.S. Cl. ..... 313/113; 313/634

[58] Field of Search ..... 313/113, 493, 313/634

[56] References Cited

U.S. PATENT DOCUMENTS

| | | |
|---|---|---|
| 4,282,563 | 8/1981 | Ohta et al. . |
| 4,420,799 | 12/1983 | Miller . |
| 4,853,591 | 8/1989 | Klein et al. . |
| 4,871,942 | 10/1989 | Burgmans et al. . |

FOREIGN PATENT DOCUMENTS

| | | |
|---|---|---|
| 31 06 721 A1 | 1/1982 | Germany . |
| 33 13 091 A1 | 10/1984 | Germany . |
| 90 14 804.5 | 3/1991 | Germany . |
| 1 514 281 | 6/1978 | United Kingdom . |
| DM/007715 | 10/1986 | WIPO . |
| WO 93/18542 | 9/1993 | WIPO . |
| WO 93/20579 | 10/1993 | WIPO . |

OTHER PUBLICATIONS

"Neues aus der Technik" (News about Technology), vol. 2, May 20, 1988, Wurzburg, Germany, p. 4, Niederdruck--Quecksilberdampf-Entladungslampe (Low-Pressure Mercury-Vapor Discharge Lamp).

*Primary Examiner*—Nimeshkumar Patel

*Attorney, Agent, or Firm*—Frishauf, Holtz, Goodman, Langer & Chick, P.C.

[57] ABSTRACT

The invention relates to a compact fluorescent light bulb in the form of a reflector lamp. The discharge vessel (3) of the light bulb according to the invention preferably comprises a plurality of U-shaped glass tubes (30, 31), which are located in the same plane at right angles to the reflector axis. As a result, on the one hand a short structural length is attained, which is only insignificantly greater than that of a commercially available general-purpose incandescent bulb, and on the other, the reflector lamp of the invention, when used in ceilings or chandeliers, has a horizontal lighting intensity that is increased by the factor of 4 over a conventional compact fluorescent light bulb.

24 Claims, 3 Drawing Sheets

COMPACT FLUORESCENT LIGHT BULB

FIELD OF THE INVENTION

The invention relates to a compact fluorescent light bulb.

The light bulb of the invention is an improved version of a compact fluorescent light bulb, especially a reflector lamp, which can be used as an energy-saving alternative to the general-purpose incandescent light bulb in ceilings and chandeliers.

BACKGROUND

In ceilings and chandeliers, commercially available compact fluorescent light bulbs, of the kind described for instance in European Patent EPO 143 419, to which U.S. Pat. No. 4,853,591, corresponds, are used virtually exclusively in a suspended position; that is, the U-shaped parts of the tube that form the discharge vessel of the compact fluorescent light bulb are oriented vertically. These compact fluorescent light bulbs, in a suspended operating position, thus produce a high vertical lighting intensity, or in other words a high lighting intensity for vertical surfaces, such as walls, but only a relatively low lighting intensity for horizontal surfaces such as table tops and floors. As a result, that compact fluorescent light bulbs that are used in a suspended operating position in chandeliers or ceiling lights may not illuminate the table and floor adequately. Moreover, in light fixtures that can be looked into from the side, the high vertical light intensity of the discharge vessel can be quite blinding to the observer when he looks at the light fixture.

International Design Application IR-DM/007715 discloses a compact fluorescent light bulb with a rotationally symmetrical funnel-shaped aluminum reflector in which the light bulb is retained axially. This compact fluorescent light bulb, provided with a reflector, does produce high horizontal lighting intensity, but because of its great structural length it is unsuitable for ceilings and chandeliers. The structural length of a compact 15 W fluorescent light bulb with its reflector is 152 mm, for instance, and the structural length of a compact 20 W fluorescent light bulb with its reflector is 186 mm. By comparison, the length of a general-purpose 60 W incandescent bulb is only 105 mm.

German Patent Disclosure DE-OS 31 06 721, to which U.S. Pat. No. 4,871,942 corresponds, describes a pressed glass light bulb formed as a compact fluorescent light bulb. In one exemplary embodiment (FIGS. 6 and 7), this light bulb has a rotationally symmetrical, funnel-like housing that encloses a ballast and has a screw-type base. The discharge vessel comprises two pressed glass parts, which are joined together in gas-tight fashion by means of a glass enamel.

A zigzag-shaped pressed glass part located inside the discharge vessel divides the discharge chamber and forms a coiled discharge path extending at right angles to the axis of the bulb.

Making this light bulb using the pressed glass technique is comparatively complicated and expensive. Applying a slurry of fluorescent material to the pressed glass parts, inserting the electrodes, and sealing off the pressed glass parts that form the discharge vessel in gas-tight fashion are especially problematic.

THE INVENTION

The object of the invention is to furnish a compact fluorescent light bulb which is suitable in a suspended operating position as a replacement for a general-purpose incandescent bulb for use in a ceiling fixture or chandelier, has a high horizontal lighting intensity, and has the least possible blinding effect.

Tubular segments of the discharge vessel located adjacent each other, which extend vertically to the lamp, and hence the reflector axis, together with the reflector generate a horizontal lighting intensity that is improved by a factor of four over conventional compact fluorescent light bulbs, with little glare. The discharge vessel advantageously comprises a plurality of U-shaped glass tubes, which are located side by side in the same plane at right angles to the reflector axis. As a result, these glass tubes and especially their legs form a flat discharge vessel, which acts as a flat projector and makes a short structural length possible for the light bulb of the invention.

These U-shaped or undulating glass tubes are formed of a rod-shaped cylindrical glass tube that in turn was melted directly from the glass furnace. That is, to produce the light bulbs of the invention, the time-tested manufacturing technique for rod- shaped fluorescent light bulbs can be employed. There is no need for recourse to the technologically more complicated and expensive pressed glass technique. The electronic ballast integrated into the connecting part of the housing, and the screw base attached to the ballast, finally make it possible to use the light bulb of the invention in ceilings and chandeliers that were originally constructed for general-purpose incandescent bulbs. The maximum structural length of the light bulb according to the invention is only 118 mm, which is thus only 13 mm more than the length of a 60 W general-purpose incandescent bulb. Ventilation slits in the reflector body, in combination with an unsealed light emission opening of the reflector, permit adequate cooling of the discharge vessel, so that an operating temperature that is optimal in terms of the light yield can be established. The light emission opening of the reflector is advantageously defined by an annular, ring-shaped covering which conceals the connecting part in which the discharge vessel is retained, and which moreover further reduces the blinding effect of the light bulb of the invention. The horizontal lighting intensity of these light bulbs can be further increased by means of a reflective coating on the inside wall of the reflector.

In another exemplary embodiment of the light bulb of the invention, a ballast integrated with the light bulb was omitted. This embodiment is intended for use in light fixtures that in turn already have a built-in electronic or conventional ballast for the operation of fluorescent light bulbs, or are arranged for use with an adapter with an integrated ballast.

DRAWINGS

The invention will be described in further detail below in terms of several exemplary embodiments. Shown are:

FIG. 1, a side view of a light bulb of the invention in a first exemplary embodiment;

FIG. 2, a plan view on the light emission opening of the light bulb of the invention;

FIG. 3, a side view of a light bulb of the invention in a second exemplary embodiment.

DETAILED DESCRIPTION

Figure 1:
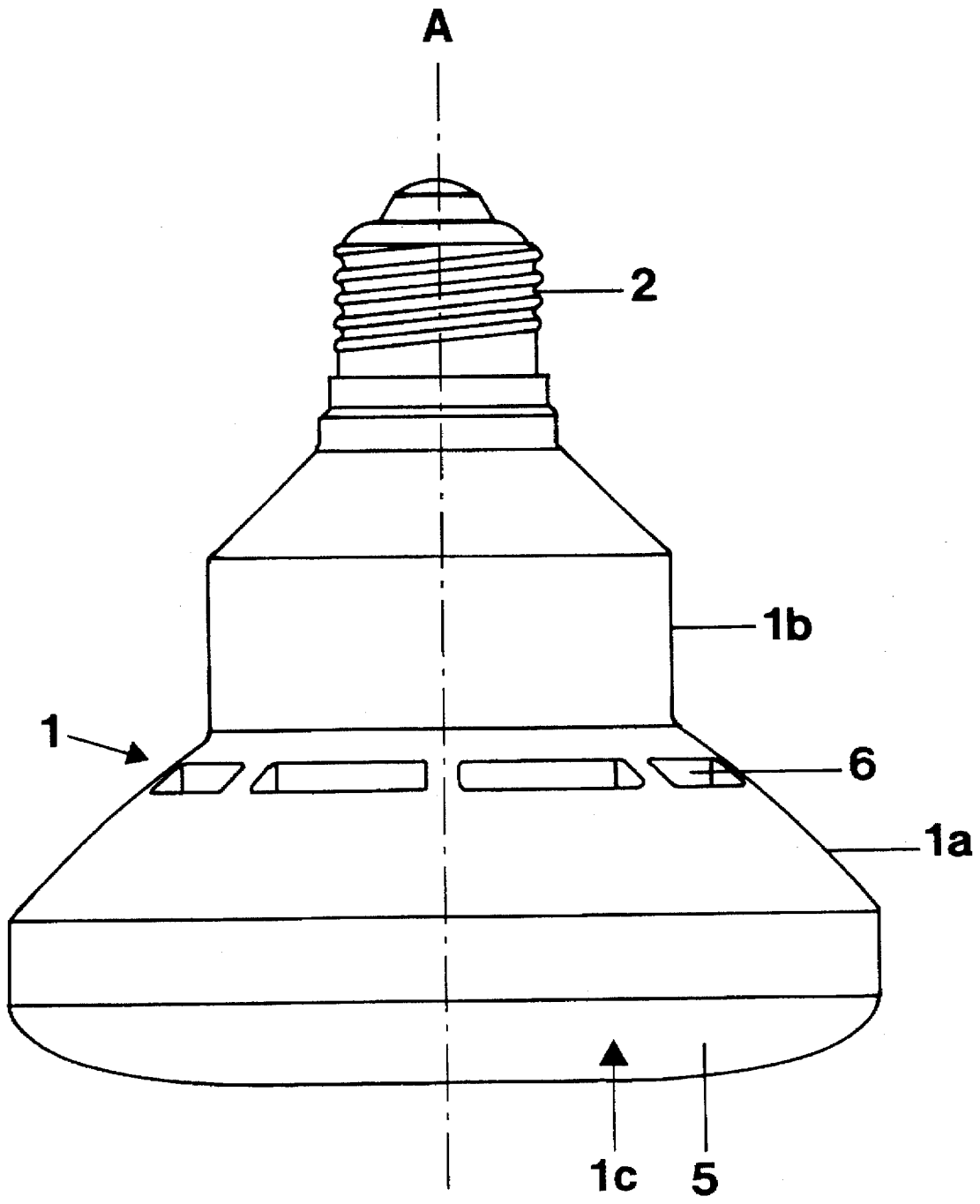
Figure 2:
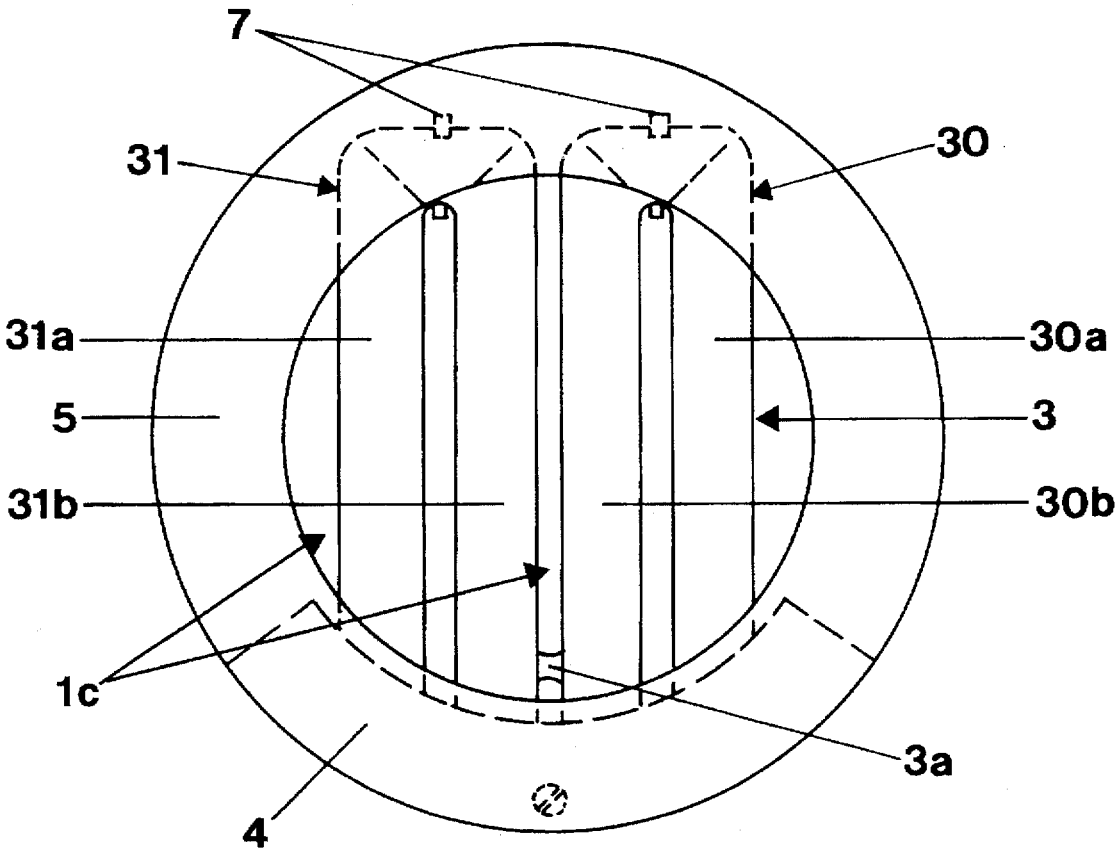

In FIGS. 1 and 2, a first exemplary embodiment of a compact fluorescent light bulb according to the invention is shown. The light bulb has a housing 1 of plastic, with a rotationally symmetrical reflector 1*a* and a connecting part 1*b*, which is equipped with a screw base 2. The reflector 1*a* mounted on the connecting part is widened in funnel-like fashion toward the light emission opening 1*c*. The discharge vessel 3 of the compact fluorescent light bulb is formed by two gas-tight-sealed U-shaped glass tubes 30, 31, which are located side by side in the same plane at right angles to the lamp, and reflector axis A, inside the reflector 1*a*. The interior of the glass tubes 30, 31 communicate via a hollow connecting bridge 3*a*, so that the result is a single cohesive discharge chamber (FIG. 2). Secured to the inner wall of the reflector 1*a* is a receptacle 4, in the form of a segment of a circle, which extends as far as the reflector bottom and in which the free legs 30*a*, 30*b*, 31*b*, 31*a* of the glass tubes 30, 31 are fixed. The outer legs 30*a*, 31*a* of the U-shaped glass tubes 30, 31 are each equipped with a gas-tight fused-in electrode (not shown), and these electrodes are electrically connected via the receptacle 4 to the electronic ballast accommodated in the connecting part 1*b*. Two retaining clamps 7 secured to the reflector wall fix the U-shaped glass tubes 30, 31 on their bent ends as well.

The light emission opening 1*c* of the reflector 1*a* is delimited by a transparent, that is, a translucent but not clear circular-annular covering 5. In the vicinity of the bottom, the reflector 1*a* has a plurality of annularly located ventilation slits 6, which in combination with the unsealed light emission opening of the reflector enable adequate air circulation to cool the light bulb. The reflector bottom is formed by a slightly conically tipped disk, on which aluminum has been vapor-deposited, to improve reflection. The tip of this disk is oriented toward the discharge vessel 3.

The 11 W version of this light bulb has a structural length (measured axially) of 114 mm and a maximum outside diameter of 108 mm, while the 15 W version of this light bulb of the invention, which is otherwise structurally the same, has a length of 118 mm (in the axial direction) and a maximum outside diameter of 128 mm.

Figure 3:
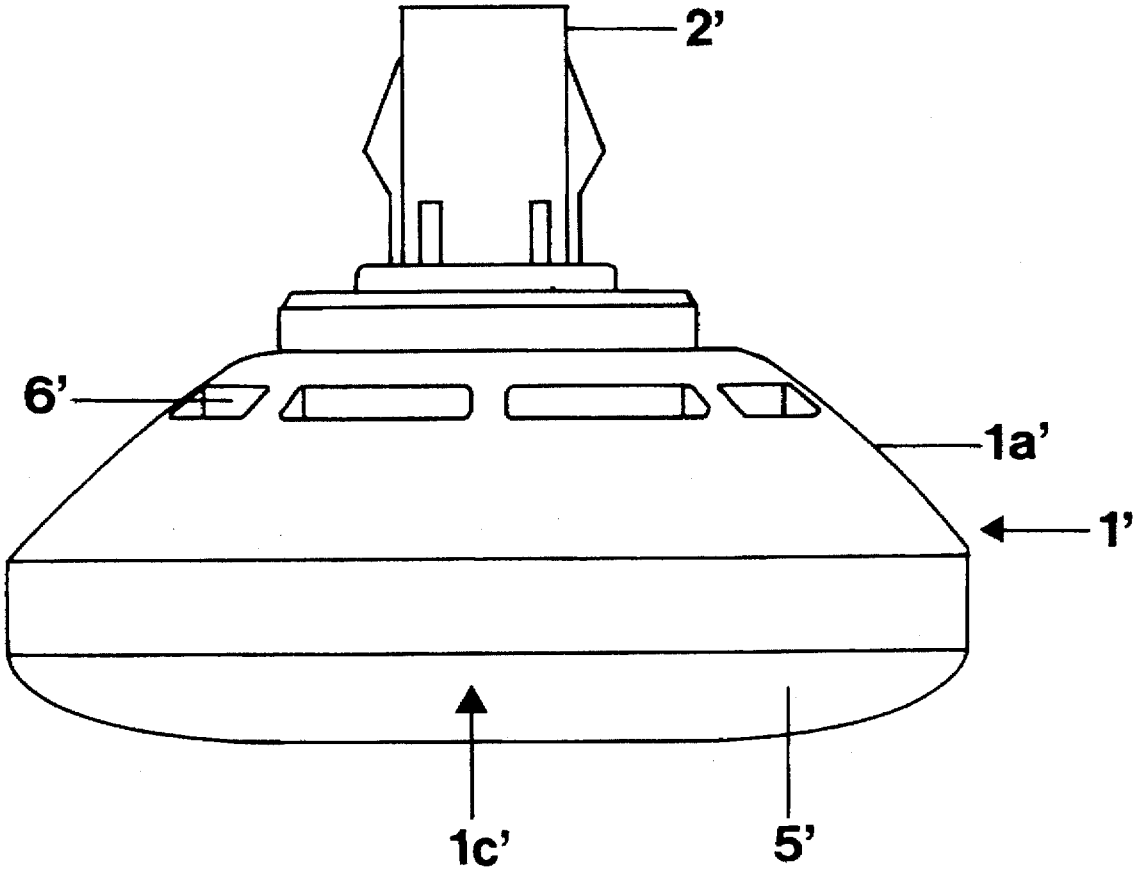

FIG. 3 shows a side view of the compact fluorescent light bulb according to the invention, in a second exemplary embodiment. This second exemplary embodiment differs from the first example described above in terms of its base 2' and in terms of the fact that the light bulb has no integrated ballast. Conversely reflector 1*a'*, the ventilation slits 6', the annular covering 5', the discharge vessel, and the receptacle are identical to the corresponding parts of the first exemplary embodiment. FIG. 2 thus also shows a plan view on the light emission opening of the light bulb of the second exemplary embodiment.

This light bulb is intended for use in light fixtures that have a built-in ballast, or for use with an adapter that has an integrated ballast.

The light bulb base 2' in this exemplary embodiment is in the form of a G 24d base (for operation with a conventional ballast) or a G 24q base (for operation with an electronic ballast).

The invention is not limited to the exemplary embodiments described above. For example, the discharge vessel of the light bulb of the invention may comprise only a single U-shaped glass tube, or more than two U-shaped glass tubes, for instance three of them. Moreover, the U-shaped glass tubes can also form a discharge vessel that has a plurality of separate discharge chambers. The discharge vessel may also comprise an undulating glass tube.

In the second exemplary embodiment, a G 23 base may for instance also be used, instead of a G 24 base.

I claim:

1. A compact fluorescent light bulb, which is suitable for use in suspended operating position in a ceiling light fixture or chandelier, comprising:

a housing (1, 1');

a rotationally symmetrical reflector (1*a*, 1*a'*) secured to the housing, said reflector being formed with an unsealed, open light emission opening (1*c*, 1*c'*) and defining a lamp axis(A);

a base (2, 2') mounted on the housing (1, 1'), and aligned with said axis;

a light-transmissive, planar discharge vessel (3) having at least one gas-tight-closed discharge chamber, said vessel enclosing an ionizable fill and electrodes for producing a low-pressure gas discharge, wherein said discharge vessel (3) comprises at least two adjacently located U-shaped glass tubes (30, 31), which glass tubes (30, 31) are located parallel side by side in the same plane and at right angles to the lamp axis (A); and wherein said electrodes are fused into said glass tubes.

2. The compact fluorescent light bulb of claim 1, including an electronic ballast, wherein the housing (1) has a connecting part (1*b*) to which the reflector (1*a*) and the base (2) are attached, and in which the electronic ballast for the light bulb is accommodated.

3. The compact fluorescent light bulb of claim 1, wherein the glass tubes (30, 31) communicate with one another and form the discharge chamber as a single chamber.

4. The compact fluorescent light bulb of claim 1, wherein the housing (1; 1') is of plastic.

5. The compact fluorescent light bulb of claim 1, wherein the reflector (1*a*; 1*a'*) has ventilation openings (6; 6'), which, in combination with the unsealed light emission opening (1*c*, 1*c'*), provide for air circulation for cooling the discharge vessel (3).

6. The compact fluorescent light bulb of claim 1, wherein the reflector (1*a*) has a receptacle (4), located laterally on its inner wall for retaining the discharge vessel (3) and for providing electrical contact to the electrodes.

7. The compact fluorescent light bulb of claim 6, wherein the light emission opening (1*c*; 1*c'*) of the reflector (1*a*; 1*a'*) is delimited by a circular-annular covering (5; 5'), shaped and dimensioned to conceal the receptacle (4).

8. The compact fluorescent light bulb of claim 7, wherein the covering (5; 5') is light-transmissive.

9. The compact fluorescent light bulb of claim 1, wherein the maximum structural length of the reflector lamp, measured in the axial direction, is 118 mm.

10. The compact fluorescent light bulb of claim 1, wherein the inner wall of the reflector (1*a*; 1*a'*) is at least partially provided with a reflective coating.

11. The compact fluorescent light bulb of claim 2, wherein the base (2) is a screw base.

12. The compact fluorescent light bulb of claim 1, wherein the base (2') is a pin base of the G 24q, or G 24d, G 23 type.

13. A compact fluorescent light bulb, which is suitable for use in suspended operating position in a ceiling light fixture or chandelier, comprising:

a housing (1, 1');

a rotationally symmetrical reflector (1*a*, 1*a'*) secured to the housing, said reflector being formed with an unsealed, open light emission opening (1*c*, 1*c'*) and defining a lamp axis (A);

a base (2, 2') mounted on the housing (1, 1') and aligned with said axis;

a light-transmissive, planar discharge vessel (3) having at least one gas-tight-closed discharge chamber, said vessel enclosing an ionizable fill, and electrodes for producing a low-pressure gas discharge, wherein said discharge vessel (3) comprises a single undulating glass tube, in which undulations of the glass tube are located adjacent each other in a plane at right angles to the lamp axis (A); and wherein said electrodes are fused into said tube.

14. The compact fluorescent light bulb of claim 13, including an electronic ballast, wherein the housing (1) has a connecting part (1*b*) to which the reflector (1*a*) and the base (2) are attached, and in which the electronic ballast for the light bulb is accommodated.

15. The compact fluorescent light bulb of claim 13, wherein the glass tube forms a single discharge chamber.

16. The compact fluorescent light bulb of claim 13, wherein the housing (1; 1') is of plastic.

17. The compact fluorescent light bulb of claim 13, wherein the reflector (1*a*; 1*a'*) has ventilation openings (6; 6'), which, in combination with the unsealed light emission opening (1*c*, 1*c'*), provide for air circulation for cooling the discharge vessel (3).

18. The compact fluorescent light bulb of claim 13, wherein the reflector (1*a*) has a receptacle (4), located laterally on its inner wall for retaining the discharge vessel (3) and for providing electrical contact to the electrodes.

19. The compact fluorescent light bulb of claim 18, wherein the light emission opening (1*c*; 1*c'*) of the reflector (1*a*; 1*a'*) is delimited by a circular-annular covering (5; 5'), shaped and dimensioned to conceal the receptacle (4).

20. The compact fluorescent light bulb of claim 19, wherein the covering (5; 5') is light-transmissive.

21. The compact fluorescent light bulb of claim 13, wherein the maximum structural length of the reflector lamp, measured in the axial direction, is 118 mm.

22. The compact fluorescent light bulb of claim 13, wherein the inner wall of the reflector (1*a*; 1*a'*) is at least partially provided with a reflective coating.

23. The compact fluorescent light bulb of claim 14, wherein the base (2) is a screw base.

24. The compact fluorescent light bulb of claim 13, wherein the base (2') is a pin base of the G 24q, or G 24d, G 23 type.

* * * * *